United States Patent [19]

Simon

[11] Patent Number: 4,489,738

[45] Date of Patent: Dec. 25, 1984

[54] SELF-EXTINGUISHING CIGARETTES

[76] Inventor: Eli Simon, 7175 Little Harbor Dr., Huntington Beach, Calif. 92648

[21] Appl. No.: 472,955

[22] Filed: Mar. 7, 1983

[51] Int. Cl.[3] ..... A24D 1/02; A24D 1/10; A24D 1/12

[52] U.S. Cl. ..... 131/349; 131/355; 131/365

[58] Field of Search ..... 131/349, 355, 365

[56] References Cited

U.S. PATENT DOCUMENTS

| | | | |
|---|---|---|---|
| 2,887,414 | 5/1959 | Rosenberg et al. | 131/355 |
| 4,044,778 | 8/1977 | Cohn | 131/349 |
| 4,303,084 | 12/1981 | Simon | 131/349 |

*Primary Examiner*—V. Millin
*Assistant Examiner*—Gregory Beaucage

[57] ABSTRACT

This invention concerns the use of specific coatings that are applied to the paper wrapper that encloses the cigarette's smoking medium for limiting in a predictable manner the free burning time of the treated cigarette, or controlling the lapsed time prior to self-extinguishment after being lit and left unattended. The coating materials are generally identified as hydrophylic colloids or aqueous-soluble polymers, that are deposited singly or as mixtures from aqueous media, and are represented by locust bean gum, pectin, sodium carboxymethylcellulose, and guar gum, forming adherent, non-tacky, flexible coatings on the paper housing substrates, and significantly altering the burning characteristic of the resultant cigarettes. Comparable behaviors are obtained, for equivalent weight percentages of the deposited solids, by either precoating the portion of paper wrapper that subsequently encloses the charge of tobacco or by post-treatment of the external surface of the assembled cigarette. For cigarettes having paper wrapper coated to contain 20±10 weight percent solids of this invention, based on the weight of the treated paper that encloses the smoking medium, after being lit and left unattended a self-extinguishing time of approximately 1½ to 3 minutes can be expected, meeting a practicable compromise for the smoker between safety and smoking convenience.

6 Claims, No Drawings

SELF-EXTINGUISHING CIGARETTES

BACKGROUND

In my U.S. Pat. No. 4,230,131, titled "Self-Extinguishing Cigatettes", I discussed the rationale for the need that lit cigarettes have a limited, controlled free burning time. The time period selected for self-extinguishment was predicated on a condition believed acceptable to the smoker without however sacrificing the objective of reducing the probability of fires caused by smoldering cigarettes inadvertently dropped onto combustible materials such as bedding and overstuffed furniture. In this invention, I disclose the use of additive systems other than either those of boric acid, benzenephosphonic acid and the aqueous reaction product between 2 moles of benzenephosphonic acid and 1 mole of melamine noted in the referenced patent, or the application of certain chlorine-containing copolymer latexes to the cigarette's paper wrapper which I disclosed in my U.S. Pat. No. 4,303,084. The resultant coated paper wrappers (of this invention) are non-tacky, flexible, and storage-stable, so that the paper subsequently to be used to enclose the tobacco charge can be pre-treated to the extent within the limits specified; pretreatment in contrast to post-treatment avoids paper staining by the aqueous mixtures while only minimally interrupting the normal cigarette production process. In comparison to my U.S. Pat. Nos. 4,230,131 and 4,303,084, both bearing the same title, the attendant advantages of this disclosure relate to avoiding the concomitant paper staining by the former invention, and the apparent elimination in altering the taste and/or odor during smoking, a possible characteristic of the latter invention, without sacrificing the stated objective for self-extinguishment.

SUMMARY OF THE INVENTION

Application of the hydrophylic colloids or water-soluble polymers of this invention to the cigarette paper wrapper, either prior or subsequent to enclosing the tobacco charge, is capable of imparting to the cigarette a controllably limited free burning time after it is lit and left unattended. In the absence of a forced intake of air, elements involved in the process of self-extinguishment appear related to the observed substantially reduced rate-of-burn of the coated cigarette as compared to that for the uncoated Control, and to an apparently reduced temperature of the burning front beneath the ash. Without being limited or confined to the following explanation, the behavior of self-extinguishment may depend on a balance in the reduced porosity of the treated paper wrapper and a change in its burning mechanism from one of flaming and subsequent rapid consumption for the uncoated paper to one of charring and a reduced rate of propagation. However, since the coating solids of this invention are inherently less flame-resistant than those deposited by the water latexes of my U.S. Pat. No. 4,303,804, and as the behavior noted is not consistent for all water-soluble or related polymers, the efficacy for imparting self-extinguishment to the cigarette by coating its paper housing with the indicated, selected, hydrophylic colloids is unusual and unpredictable in its performance.

The film properties of the coated cigarette paper wrapper are such that after treatment and drying, it can be stored, and otherwise managed in accordance with conventional practices. For the purposes of esthetics, quality control with regard to the weight percent of the deposited solids, and compatibility with manufacturing practices, the methods of pre-treatment, as compared to coating after the smoking medium is enclosed, is the preferred choice.

In determining the burning characteristics of lit and unattended cigarettes, the testing conditions were uniformly controlled, namely: the lit cigarettes were supported with the burning end free of physical contact in an upward position of 30° from the horizontal, and augmented air movement was provided from a wall-mounted forced air unit; the time of expiration was taken when there was no visible emission of smoke and the cigarette could not be "re-ignited" by the drawing-in of air.

The free burning time of the cigarette, or the lapsed time between lighting and self-extinguishment, is adjusted to be within 3 minutes, having a range of approximately $1\frac{1}{2}$ to 3 minutes, providing a reasonable continuity-of-burning to the smoker while meeting the need for a reduced smoldering time when lit and inadvertently left unattended; this provision for self-extinguishment is made by controlling the weight percent to $20 \pm 10$ for the coating deposited by the specified hydrophylic colloids or water-soluble polymers, based on the total weight of the treated paper wrapper enclosing the smoking medium.

Coating of the paper wrapper to limit the free combustion time of the cigarette significantly reduces the rate-of-burn during the lit condition but appears to have no adverse effects on ash stability, odor and taste of the effluents, and the quantity of the effluent products of combustion transferred through the filter tip, as indicated by comparing the ambient temperature condensibles of treated cigarettes with uncoated filter tip Controls; in this test, the weight differential of cotton absorbers is quantitatively obtained after heating for 15 minutes at 100° C. prior to each weighing, and is identified as "net passed catch" in the related example that is presented later.

DESCRIPTION OF THE INVENTION

Self-extinguishment of lit cigarettes when left unattended is accomplished by coating the paper wrapper with aqueous solutions of selected hydrophylic colloids or water-soluble polymers; the adjustment of the "free" combustion time period is controlled by the weight percent of the solids deposited, based on the total weight of that portion of the treated paper that encloses the charge of tobacco. After application to the paper wrapper, water release is required, forming non-tacky, adherent, and flexible coatings to the paper housing substrate that are stable at ambient conditions with regard to normal humidity effects. Food preservatives that are well known to the art (such as sorbic acid, potassium sorbate, methyl p-hydroxy benzoate, propyl p-hydroxybenzoate, calcium propionate, sodium benzoate, etc.) may optionally be used in small amounts to the aqueous, bulk mixtures if long term aging of these appear to require stabilization, without however altering or limiting their efficacy for subsequently imparting the self-extinguishing characteristic to the treated cigarette.

The coatings which have been effective in meeting the objective of "timed" self-extinguishment have been variously referred to, such as hydrophylic colloids, hydrocolloids, and water-soluble polymers. While these are particularly identified as locust bean gum. guar gum, pectin, and sodium carboxymethylcellulose, it will be recognized that individual chemical variations, either by intent or as a natural consequence, may exist and yet remain effective for the purpose intended without losing identification with its generic family. As further verification of the uniqueness of specified, workable hydrophylic colloids, it is noted that the polymers of gum acacia, polyvinyl alcohol, and ethyl cellulose were ineffective (as will be shown under the section "Examples of the Invention") in providing self-extinguishment when applied to the paper wrapped in a manner previously described, indicating uncommon behaviors for the locust bean gum, guar gum, pectin, and sodium carboxymethylcellulose.

For greater ease of application to the paper wrappers, the hydrocolloid concentration in aqueous solution was used at a solids content of 2 parts by weight (grams) to 100 parts by volume (ml) of water. Water release was easily and quickly accomplished by hot air drying; to insure against abnormal moisture retention, which could affect (favorably) the propensity of the cigarette to self-extinguish, the hot air drying was followed by oven exposure at 60° C. for two hours. With the exception of the pectin aqueous preparation, the viscosities of the other hydrophylic colloids (at the concentrations given) favored application by brushing or roller-coating rather than by spraying. For equivalent coating weight percentages of the paper wrapper, comparable self-extinguishing times are obtained by both methods of treatment, namely, pre-treatment of the paper wrapper prior to its enclosing the tobacco and post-treatment of the assembled cigarettes. The method of pre-treatment is preferred as it avoids staining of the paper wrapper by migration of the water-extracted tobacco, and is more compatible with current manufacturing practices.

To determine whether the coatings deposited from aqueous mixtures of locust bean gum, guar gum, pectin, and sodium carboxymethyl cellulose, within the weight range specified in this disclosure, namely 20±10 weight percent of the total weight of the treated paper wrapper, adversely affects the quantity of effluents from a lit cigarette, comparison of the ambient temperature condensible products was made by smoking the cigarettes in a vertical position using as "draw" a simulated smoking device at a constant vacuum differential of two inches of water. The products of combustion were caught doqnstream of the filter tip by pre-weighed cotton plugs of 0.400 g. each, and the net increase in weight of the absorbers after heating for 15 minutes at 100° C. (oven-heat) before and after smoking is termed the "net passed catch"; this is believed to be an important parameter as it reflects the quantity of combustion by-products that the smoker could inhale, in excess of that retained by the filter tip.

These and other aspects of the invention will be discussed, expanded on, and defined further in the examples set forth.

EXAMPLES OF THE INVENTION

Example 1

In this example, aqueous mixtures of locust bean gum, guar gum. pectin, and sodium carboxymethylcellulose (each containing 2.0 g. solids per 100 ml. distilled water) were used to coat the paper wrappers, exclusive of the filter tips, of Carlton 100 cigarettes from which the charges of tobacco had first been removed. After hot air drying, followed by 2 hours at 60° C. (oven heat) and 24 hours at an ambient temperature of approximately 20° C. for weight equilibration, the weight of the deposited coatings was determined from which its weight percent of the treated paper wrapper was then calculated; the coated, cylindrically-intact, paper wrapper housings were repacked with the same charges of tobacco previously removed, and the burning characteristics at the outer, center, and inner sections of each of the cigarettes obtained after being lit and left unattended. Observations and results are given in Table I with regard to the weight percentages of the treated paper wrappers, and the self-extinguishing behavior of the respective cigarettes; additional comments relating to the physical properties of the coatings, and the effects of the coatings on "draw", rate-of-burn and odor and taste during sustained, normal smoking are given in the notes following.

TABLE I

| Hydrophylic colloid (chemical name, and vendor supplier) | Weight % of the paper wrapper | Burning evaluation of treated Carlton 100 cigarettes after being lit & left unattended |
|---|---|---|
| Locust bean gum (Hercules, Inc. FL 50-40) | 8.9 to 19.0 | Each of the three sections self-extinguished within the range of 1¾ to 2¼ minutes. |
| Guar gum (Hercules, Inc. FG 60-70) | 10.5 to 20.3 | Each of the three sections self-extinguished within the range of 1½ to 2½ minutes. |
| Guar gum (Henkel Corp. Galactasol 211) | 9.5 to 20.5 | Each of the three sections self-extinguished within the range of 1½ to 2½ minutes. |
| Pectin (Hercules, Inc. DD slow set) | 9.5 to 34.6 | Each of the three sections self-extinguished within the range of 1¼ to 2½ minutes. |
| Sodium carboxy-methylcellulose (Hercules, 7M) | 5.5 to 32.9 | Each of the three sections self-extinguished within the range of 2 to 2¼ minutes. |

NOTES (to Table I)

(1) All of the coatings were non-tacky, adherent to the paper substrate, and resulted in no significant color change to the treated housings.

(2) The rates-of-burn of the lit cigarettes, left unattended, were significantly reduced, compared to the untreated Controls.

(3) Changes in the taste and odor during smoking were not apparent.

(4) Within the range of 20 ± 10 weight percent coating (based on the total weight of the treated housing, draw did not appear to be a deterring factor.

(5) An average coating weight percent of approximately 15 is suggested as near optimum, satisfying the variations in quality control, and the requirement of self-extinguishment within three minutes, while having minimum changes (compared to the characteristics of the untreated Controls) during smoking.

(6) Hercules CMC 7M (0.65 to 0.85 substitution) can be used interchangeably with other water-soluble sodium carboxymethyl-celluloses, illustrated by CMC 4M (0.38 to 0.48 substitution), & CMC 9MP (0.85 to 0.95 substitution). Reference for composition information: Hercules brochure, "Properties & Uses - Cellulose Gum, Sodium Carboxymethylcellulose" - 1963

Example 2

The provisions described in Example 1 were followed in this example (the results of which are given in Table II) with the exception that the aqueous solution of the locust bean gum, from Hercules Inc., was replaced by a laboratory-prepared crude water-extract of beans that had been removed from pods of the carob or locust tree, having the objective of demonstrating general applicability of the listed hydrophylic colloids, ie., one not dependent on a particular or purified composition. The obvious differences in the use of the "crude" extract were a reduced viscosity at the same solids content and a change in color of the treated paper wrapper from water-white of Example 1 to a light tan in this example.

TABLE II

| Treatment of Carlton 100 Paper Wrappers with Unpurified Aqueous Extract of Locust Beans | | |
|---|---|---|
| Coating composition | Wt. % of treated paper wrapper | Burning evaluation of treated Carlton 100 cigarettes |
| 2.0 g. solids in 100 ml $H_2O$ | 10.5 to 15.0 | Self-extinguished repeatedly within 1¾ to 2¼ minutes |

Example 3

In this example correspondance is shown between post-coating that portion of the paper wrapper that encloses the charge of with pre-treatment, as noted in Examples 1 and 2. Using Carlton 100 cigarettes, brush coats of the aqueous compositions (from Ex. 1 and 2) were applied to the outer surfaces of the paper housings, depositing on the average approximately 15 wt.% dried coatings, based on the total weight of the treated paper wrapper that enclosed the charge of tobacco. After an initial hot air dry, the cigarettes were heated for two hours at 60° C. (oven heat) and equilibrated for 24 hours at an ambient temperature of approximately 20° C. before smoking evaluation. In each case, the cigarettes repeatedly self-extinguished within a time range of 1½ to 2½ minutes, after being lit and left unattended, and (characteristically) had markedly reduced rates-of-burn as compared to untreated Controls.

Example 4

In this example, Carlton 100 cigarettes prepared as in Ex. 2 were tested after aging at an ambient temperature of approximately 20° C., and a second similarly prepared and aged set was oven-heated at 60° C. for two hours and tested immediately after removal from the heated atmosphere to determine both the effects of normal aging and superimposed dehydration on the quality for self-extinguishment. As the results show, following, the variations in moisture content (imbibed or lost by the coatings) were such as to not constitute a determining factor in affecting either the ability or the time to self-extinguish.

(1) For the cigarettes containing 10.5 weight percent of coating solids and aged for three months in an ambient atmosphere at a temperature of approximately 20° C., the self-extinguishing times averaged 2, 2, and 1 minute.

(2) For the cigarettes containing 12.1 weight percent of coating solids, similarly prepared, aged for three months at approximately 20° C. and heated for two hours at 60° C. immediately befoe smoking, the self-extinguishing times averaged 1¾,2, and 1¾ minutes.

(3) Comparing the self-extinguishing times for the "aged" cigarettes to those of Example 2 (Table II), the conclusion is drawn that aging and/or drying beyond that for the initial preparing of the paper wrappers had no significantly observed adverse effect on the subsequent ability to self-extinguish in accordance to the parameter of this disclosure.

EXAMPLE 5

In this example, the efficacy is shown of using aqueous solutions of mixed hydrocolloids selected from locust bean gum, guar gum, pectin, and sodium carboxymethylcellulose as coatings for the paper housings to impart the characteristic of self-extinguishment. Those mixtures containing pectin as a component have the added benefit of reduced viscosity (as compared to that of the other single hydrocolloids) favoring improved ease-of-application. The compositions are identified in Table III as A,B, and C containing, respectively: 1.0 g. locust bean gum and 1.0 g. pectin in 100 ml. distilled water; 1.0 g. locust bean gum and 1.0 g. guar gum in 100 ml. distilled water; and 1.0 g. locust bean gum and 1.0 g. sodium carboxymethylcellulose in 100 ml. distilled water. The procedure noted in Ex. 1 of precoating the empty paper housings, hot air drying, oven drying for two hours at 60° C., aging at ambient for 24 hrs., repacking with the charge of tobacco previously removed, and smoking evaluation was similarly followed.

TABLE III

| Mixed Hydrocolloids As Coatings For Paper Wrappers | | |
|---|---|---|
| Mixture number | Wt. % coating of treated housing | Burning evaluation of paper wrapper-treated Carlton 100 cigarettes |
| A | Range of 7.3 to 20.3% | Repeated self-extinguishment within 2 to 2¼ minutes |
| B | Approx., 15% | Repeated self-extinguishment within 2 minutes |
| C | Approx., 15% | Repeated self-extinguishment within 2 minutes |

Example 6

In this example several name brand cigarettes are substituted for the Carlton 100's of Examples 1–5 inclusive. These were processed by pre-coating the empty paper wrappers with the aqueous solutions of pectin, locust bean gum. guar gum, and sodium carboxymethylcellulose so as to deposit 13–17 weight percent solids, based on the total weight of each of the treated housings. After appropriately drying and aging, the wrappers were repacked with the same charge of tobacco that had previously been removed, after which they were smoke-tested and evaluated for the characteristic of "self-extinguishment". The cigarettes included: Real (R. J. Reynolds Tobacco Co.); True (Lorillard); Now (R. L. Reynolds Tobacco Co.); Vantage (R. J. Reynolds Tobacco Co.); and L & M Long Lights (Liggett Group, Inc.). Each repeatedly self-extinguished in less than three minutes, the time periods ranging from 1½ to 2½ minutes. All had markedly reduced rates-of-burn in the lit and unattended condition (as compared to their untreated Controls), and none showed significant changes in the subjective aspects such as taste and odor.

Example 7

In this example, the quantities of ambient temperature condensible effluents are compared from mechanically-smoked cigarettes that contain uncoated and treated paper wrappers. The results, indicative of no adverse effects due to the coatings, were obtained in accordance with the procedure described under the section of this disclosure, titled "Description of the Invention". For the tobacco-containing smoking medium, represented by Carlton 100's, there is no significant change attributable to the coatings, separately applied to the paper wrapper within the limits specified for securing self-extinguishment, Thus, the uncoated Carlton Controls yielded a "net passed catch" (for a 65 mm burn) of 9 mg. average under a water differential of two inches vacuum mechanically smoked in a vertical position. Treated Carlton 100 cigarettes, wherein the housings were separately coated (to the extent of 15–20 wt.% of the total weight of the housing enclosing the charge of tobacco) with aqueous solutions of pectin, guar gum. locust bean gum, and sodium carboxymethylcellulose yielded "net passed catches" of 7 to 10 mg. for the same burn length of 65 mm, or values within the variables of the experiment, particularly with regard to the consistency of the bulk density of the tobacco when repacked into the coated housings.

Example 8

In this example, the ineffectiveness of ethyl cellulose, polyvinyl alcohol, and gum acacia to provide self-extinguishment when used similarly to locust bean gum, pectin, etc., as noted in Examples 1–6 inclusive is presented, demonstrating the inability to have predicted the efficacy of the coatings of this invention and consequently reinforces their stated novelty; in the related context, it is assumed that the usefulness of the concept in providing for self-extinguishment is readily accepted. The results of these tests are given in Table III, with supplemental information by the notes, following.

TABLE III

| Coating for paper wrappers | Wt. % of treated Carlton 100 housings | Burning evaluation of treated Carlton 100 cigarettes after being lit & left unattended |
|---|---|---|
| Ethyl Cellulose (see note 1) | 12.1 to 33.8 | Did not self-extinguish within a three minute time period. |
| Gum acacia (see note 2) | approximately 15 wt. % | Did not self-extinguish within a three minute time period. |
| Polyvinyl alcohol | 10 to 20 wt. % | Did not self-extinguish within a three minute time period. |

TABLE III-continued

| Coating for paper wrappers | Wt. % of treated Carlton 100 housings | Burning evaluation of treated Carlton 100 cigarettes after being lit & left unattended |
|---|---|---|
| (see note 3) | | |

NOTES (for Table III)
(1) Composition of ethyl cellulose coating solution: 2.5 g. Hercules N-50 ethyl cellulose (47.5–49.0% ethoxyl content) in a mixture of 40 ml. benzene plus 10 ml. isopropanol.
(2) Composition of gum acacia solution: 10.0 g. gum acacia in 90 ml. distilled water.
(3) Composition of polyvinyl alcohol solution: 10.0 g. du Pont 51-05 polyvinyl alcohol (86–89% hydrolyzed) in 90 ml. distilled water.

I claim:

1. A self-extinguishing cigarette comprising a paper wrapper enclosing a charge of tobacco wherein uniformily distributed on the wrapper is an aqueous solution of a hydrophylic, film-forming adhesive selected from the group consisting of: locust bean gum, pectin, guar gum, and sodium carboxymethyl cellulose in an effective amount so as to cause said cigarette to self-extinguish when lit and left unattended.

2. A self-extinguishing cigarette according to claim 1 in which uniformly distributed on the wrapper are mixtures of hydrophylic, film-forming adhesives selected from the group consisting of: locust bean gum, pectin, guar gum, and sodium carboxymethyl cellulose in an effective amount so as to cause said cigarette to self-extinguish when lit and left unattended.

3. A self-extinguishing cigarette according to claim 1 in which uniformly distributed on the wrapper is a mixture of hydrophylic, film-forming adhesives consisting of colloids containing pectin as one of the components in an effective amount so as to cause said cigarette to self-extinguish when lit and left unattended.

4. A self-extinguishing cigarette according to claim 1 in which the hydrophylic, film-forming adhesive is a colloid and comprises 10–30 percent by weight of the total weight of the paper treated.

5. A self-extinguishing cigarette according to claim 1 in which the hydrophylic, film-forming adhesive is a colloid and is uniformly distributed on the wrapper in an amount effective to comprise 15 weight percent coating solids based on the total weight of the paper treated.

6. A self-extinguishing cigarette according to claim 1 in which the treated cigarettes self-extinguish within 1½ to 3 minutes when lit and left unattended.

* * * * *